United States Patent [19]

McClearn

[11] Patent Number: 4,822,294

[45] Date of Patent: Apr. 18, 1989

[54] SEALING GROMMET ASSEMBLY FOR WIRING HARNESS

[75] Inventor: Lisa J. McClearn, Warren, Ohio

[73] Assignee: General Motors Corporation, Detroit, Mich.

[21] Appl. No.: 14,572

[22] Filed: Feb. 13, 1987

[51] Int. Cl.[4] ..... H01R 13/52

[52] U.S. Cl. ..... 439/274; 439/559; 439/452

[58] Field of Search ..... 439/271–276, 439/279, 452, 281, 282, 283, 529, 544, 550, 552, 556, 559, 562, 564, 571–573; 29/837, 841, 842

[56] References Cited

U.S. PATENT DOCUMENTS

| | | | |
|---|---|---|---|
| 2,563,712 | 8/1951 | Frei et al. | 439/279 |
| 3,171,887 | 3/1965 | Cross et al. | 439/271 |
| 3,327,282 | 6/1967 | Krolak | 439/275 |
| 3,576,517 | 4/1971 | Johnson et al. | 439/274 |
| 4,173,349 | 11/1979 | Neale, III | 439/279 |
| 4,214,802 | 7/1980 | Otani et al. | 439/275 |
| 4,492,421 | 1/1985 | Ito | 439/271 |
| 4,711,509 | 12/1987 | Cross et al. | 439/271 |
| 4,767,350 | 8/1988 | Cooper et al. | 439/271 |

*Primary Examiner*—David Pirlot

*Attorney, Agent, or Firm*—F. J. Fodale

[57] ABSTRACT

A sealing grommet assembly comprises a support plate having a seal well in which an elastomeric cable seal is disposed. The grommet assembly is made in conjunction with a wiring harness having an electrical end connector which also has an elastomeric cable seal. The grommet assembly and electrical end connector are processed in a juxtaposed relationship for inserting the electrical conductors of the wiring harness through the juxtaposed parts simultaneously prior to termination of the electrical conductors.

9 Claims, 2 Drawing Sheets

SEALING GROMMET ASSEMBLY FOR WIRING HARNESS

BACKGROUND OF THE INVENTION

This invention relates generally to a grommet assembly for a wiring harness, and more particularly, to a sealing grommet assembly for passing a plurality of electrical conductors or the like through a hole in a panel and sealing off the hole through the panel; a wiring harness having the grommet assembly and a method of making the wiring harness which has the grommet assembly.

SUMMARY OF THE INVENTION

The object of this invention is to provide an improved sealing grommet assembly which is versatile, relativeley inexpensive to manufacture and reliable.

A feature of the invnetion is that the sealing grommet assembly includes a separate elastomeric cable seal which is interchangeable for different numbers or sizes of electrical conductors to provide versatility.

Another feature of the invention is that the sealing grommet assembly is designed for processing in a juxtaposed position with an electrical end connector of a wiring harness to reduce manufacturing and assembly cost and improve reliability.

Other objects and features of the invention will become apparent to those skilled in the art as the disclosure is made in the following detailed description of a preferred embodiment of the invention as illustrated in the accompanying sheets of drawing in which:

DESCRIPTION OF THE PREFERRED EMBODIMENT

Figure 1:
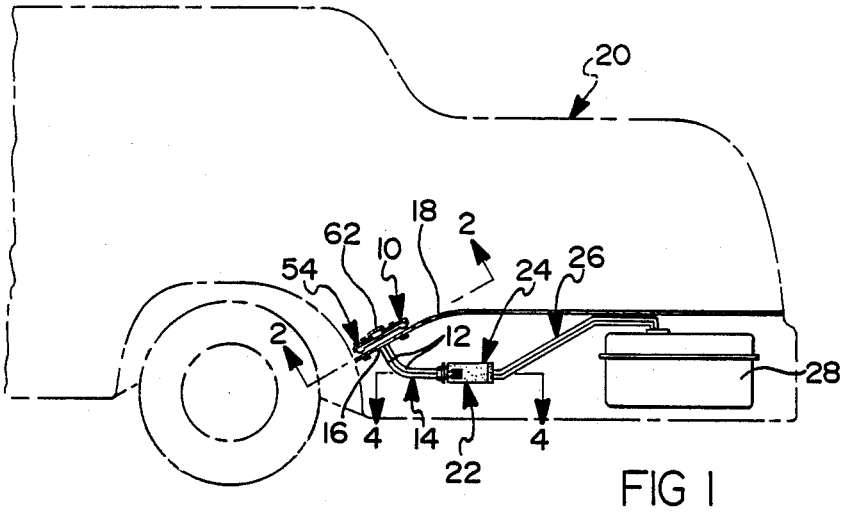
FIG. 1 is a schematic view showing a sealing grommet assembly in accordance with this invention attached to the floor pan of an automobile.

Referring now to the drawing, FIG. 1 shows a sealing grommet assembly 10 for passing a plurality of electrical conductors 12 of a wiring harness 14 through a hole 16 in a panel 18 (floor pan) of an automobile 20 in a sealed fashion. The wiring harness 14 includes an electrical end connector 22 which is connected to a mating electrical end connector 24 of a second wiring harness 26 for an electrical fuel pump (not shown) in a fuel tank 28.

Figure 3:
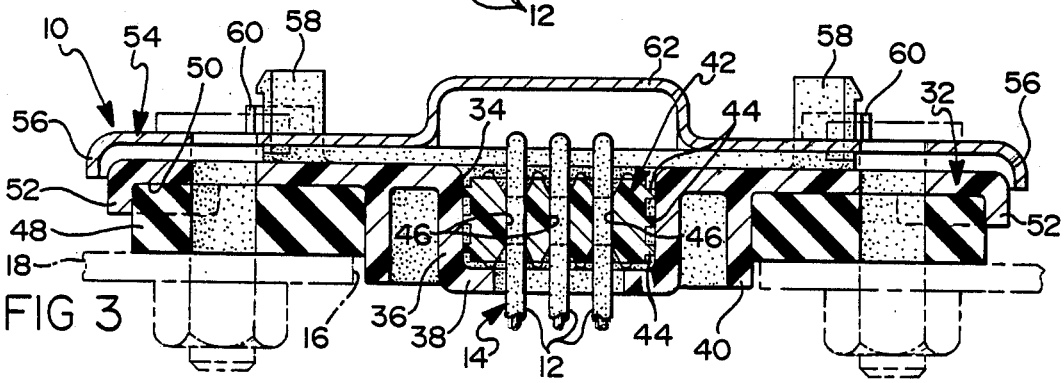
FIG. 3 is a sectional view of the grommet assembly taken substantially along the line 3—3 of FIG. 2 looking in the direction of the arrows.

The sealing grommet assembly 10 comprises a diamond-shaped support plate 32, of nylon or other suitable thermoplastic material, which attaches the sealing grommet assembly 10 to the panel 18 so that it covers the hole 16 which extends through the panel 18 as shown in FIG. 3. The support plate 32 has a central rectangularly-shaped seal well 34 which includes a peripheral wall 36 which projects perpendicularly from the support plate 32 and a annular base ledge 38 at the remote end of the peripheral wall 36. The annular base ledge 38 is spaced from the support plate 32 in a parallel fashion by the peripheral wall 36.

Figure 2:
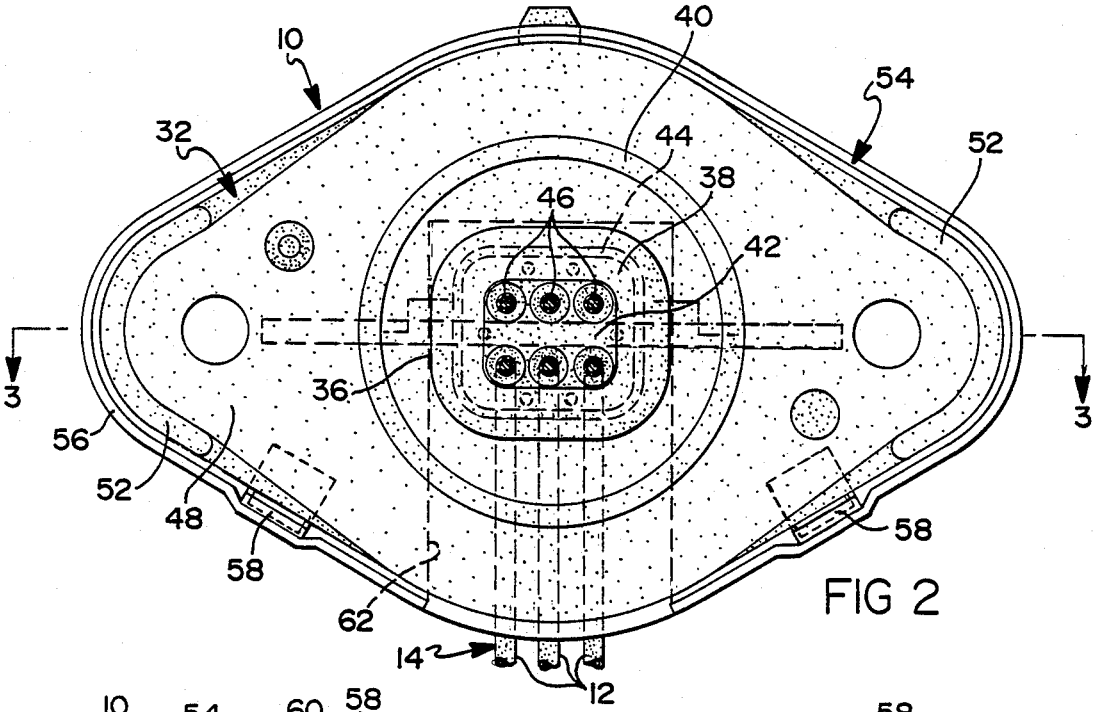
FIG. 2 is a plan view of the grommet assembly taken substantially along the line 2—2 of FIG. 1 looking in the direction of the arrows.

The support plate 32 also includes an annular pilot wall 4 which projects perpendicularly from the support plate 32 in the same direction and for substantially the same distance as the peripheral wall 36 of the seal well 34. The pilot wall 40 surrounds the seal well 34 in a spaced relationship as shown in FIGS. 2 and 3 and it is sized so that it passes through the hole 16 in the panel 18 as shown in FIG. 3.

The grommet assembly 10 further comprises an elastomeric cable seal 42 which is disposed in the seal well 34. The elastomeric cable seal 42 has a plurality of peripheral lips 44 which sealing engage the inside surface of the peripheral wall 36 of the seal well 34 and a plurality of apertures 46 which extend through the elastomeric cable seal 42. The apertures 46 slidably and sealingly engage individual electrical conductors 12 of the bundle of electrical conductors which form the wiring harness 14 which extends through the hole 16 in the floor pan 18.

The grommet assembly 10 further comprises an annular, diamond-shaped gasket 48 of sealing material which is piloted on the pilot wall 40 and located by a pair of diametrically opposed corner flanges 52 depending from the apexes of the diamond-shaped support plate 32. The diamond-shaped gasket 48 forms a face seal between the surface 50 of the support plate 32 and the surface of the panel 18 around the hole 16 when the support plate is attached to the panel by nuts and bolts or other suitable fastening means as shown in FIG. 3.

The grommet assembly 10 may also include a diamond-shaped sheet metal cover 54 which is mounted on the support plate 32 on the opposite side of the seal well 34 and the pilot wall 40. The sheet metal cover 54 has a peripheral lip 56 which fits around the periphery of the support plate 32 as best shown in FIG. 2 and it is retained on the support plate 32 by plastic lock arms 58 of the support plate 32 which extend through slots in the sheet metal cover 54 and engage bent-up ears 60 of the sheet metal cover 54. The sheet metal cover 54 also includes a channel portion 62 which covers the seal well 34 and extends to an edge of the sheet metal cover 54 which is between the corner flanges 52. The channel portion 62 directs the electrical conductors 12 extending through the elastomeric cable seal 42 at a right angle and parallel to the upper surface of the support plate 32.

Figure 5:
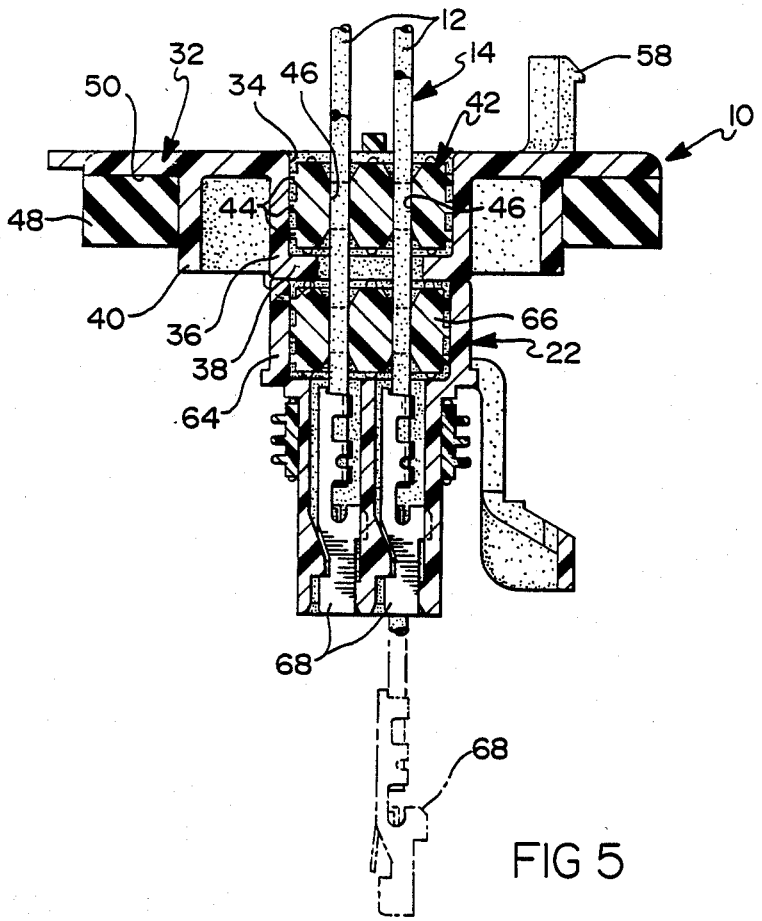
FIG. 5 is a sectional view similar to FIGS. 3 and 4 showing the relationship of the grommet assembly and the electrical end connector of its wiring harness during the manufacturing process.
Figure 4:
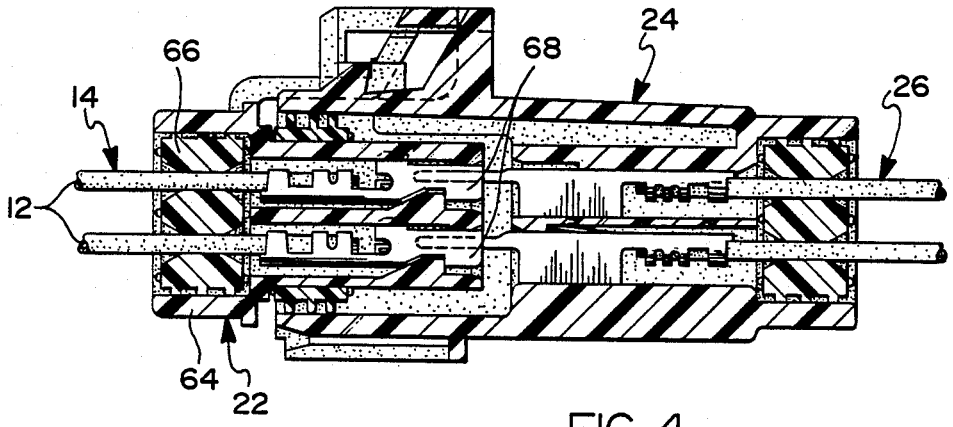
FIG. 4 is a sectional view of mated electrical end connectors of wiring harnesses associated with the grommet assembly taken substantially along the line 4—4 of FIG. 1 looking in the direction of the arrows.

The sealing grommet assembly 10 is designed for processing in a juxtaposed position with the electrical end connector 22 for the wiring harness 14 as shown in FIG. 5. In this juxtaposed position, the seal well 34 of support plate 32 is abutted against the cable end of the thermoplastic connector body 64 of electrical end connector 22. The elastomeric cable seal 42 may be preinstalled or installed in the seal well 34 at this time. The electrical end connector 22 may also have a cable seal 66 as shown in FIG. 5, in which case the cable seal 66 is installed before the sealing grommet assembly 10 is juxtaposed the cable end of the connector body 64. It is also advantageous to use cable seals 42 and 66 of identical design as shown in FIG. 4. In any event, the aperture patterns of the cable seals 42 and 46 must match.

After elastomeric cable seals 42 and 66 are installed, the juxtaposed support plate 32 and connector body 64 are then processed as one part.

The individual electrical conductors 12 are inserted through the respective apertures 46 of the elastomeric cable seal 42 and the corresponding apertures of the elastomeric cable seal 66 until the electrical conductors 12 extend out the connector end of the connector body 64 as shown in phantom in FIG. 5. Terminals 68 are then attached to the ends of the electrical conductors 12 in a conventional manner. The electrical conductors 12 are then pulled back through the cable seals 42 and 66 until the attached terminals 68 are pull-to-seat in a latched position in the connector body 66 as shown in solid lines in FIG. 5. The cover plate 54 is then attached and the gasket 48 installed if it has not been preinstalled.

The wiring harness 14 is then shipped and handled with the sealing grommet assembly 10 juxtaposed the electrical end connector 22 until the sealing grommet assembly is attached to the panel 18 as shown in FIG. 3.

After the grommet assembly 10 is attached, the electrical end connector 22 is simply pulled away from the attached grommet assembly 10 and mated to the electrical end connector 24 of the wiring harness 26 as shown in FIG. 1.

The sealing grommet assembly 10 is shown as passing six electrical conductors 12 of a particular size through the hole 16 in the panel 18. However, different numbers and sizes of electrical conductors 12 and other like items such as fiber optic cables and pneumatic hoses can be accommodated simply by interchanging the elastomeric cable seal 42 to one having the appropriate numbers and size of apertures.

Thus the sealing grommet assembly 10 is very versatile particularly when used in combination with an electrical end connector, such as end connector 22, which has an identical cable seal 66.

The processing of the grommet assembly 10 simultaneously with the end electrical connector 22 reduces manufacturing and assembly costs because the electrical conductors 12 are inserted through the elastomeric cable seal 42 and the connector body 64 at the same time. This simultaneous processing also improves reliability because the proper seating of an attached terminal 68 in the connector body 64 for each electrical conductor 12 which passes through the grommet assembly 10 is assured.

Manufacturing costs are also reduced because a variety of assemblies can be made simply by changing the configuration of the cable seals.

I wish it to be understood that I do not desire to be limited to the exact details of construction shown and described, for obvious modifications will occur to a person skilled in the art.

The embodiments of the invention in which an exclusive property of privilege is claimed are defined as follows:

1. A sealing grommet assembly for passing a plurality of electrical conductors or the like through a hole in a panel and sealing off the hole through the panel comprising:

a support plate for attaching the sealing grommet assembly to a panel having a hole extending through the panel, said support plate having a seal well which includes a peripheral wall projecting from the support plate and a base ledge at the end of the peripheral wall spaced from the support plate, said support plate further including a pilot wall which projects from the support plate and surrounds the seal well in a spaced relationship, said pilot wall being sized to pass through the hole which extends through a panel to which the support plate is to be attached, an elastomeric cable seal disposed in the seal well, said elastomeric seal block having a peripheral lip sealingly engaging an inside surface of the seal well and a plurality of apertures extending through the lastomeric cable seal for slidably and sealingly engaging individual electrical conductors, or the like, of a wiring harness, or the like, which is to be passed through the hole in the panel, a gasket surrounding the pilot wall of the support plate to provide a face seal between a surface of the support plate outwardly of the pilot wall and a surface of the panel surrounding the hole when the support plate is attached to the panel, and a cover which is attached to the support plate on the opposite side of the seal well, said cover having a channel portion which covers the seal well and which extends to an edge of the cover to direct the electrical conductors extending through the cable seal in a direction generally parallel to the support plate.

2. A wiring harness having a plurality of electrical conductors or the like comprising, a sealing grommet assembly for passing the plurality of electrical conductors through a hole in a panel, and an electrical end connector for the electrical conductors which are passed through the hole in the panel, said sealing grommet assembly comprising:

a support plate for attaching the sealing grommet assembly to the panel over the hole, said support plate having a seal well which includes a peripheral wall projecting from the support plate and a base ledge at the end of the peripheral wall spaced from the support plate, said support plate further including a pilot wall which projects from the support plate and surrounds the seal well in a spaced relationship, said pilot wall being sized to pass through the hole which extends through the panel, an elastomeric cable seal disposed in the seal well, said elastomeric cable seal having a peripheral sealing lip engaging an inside surface of the seal well and a plurality of apertures extending through the elastomeric cable seal slidably and sealingly engaging respective individual electrical conductors of the wiring harness, and a gasket surrounding the pilot wall of the support plate to provide a face seal between the support plate and the panel around the hole when the support plate is attached to the panel, and said electrical end connector comprising:

a connector body and a plurality of terminals attached to respective individual electrical conductors of the wiring harness, and said sealing grommet assembly being slidably movable on the electrical conductors of the wiring harness in a direction away from the electrical end connector.

3. The wiring harness as defined in claim 2 wherein, the connector body has a cable end which is juxtaposed the sealing grommet assembly on the seal well side of the sealing grommet assembly.

4. The wiring harness as defined in claim 3 wherein the electrical end connector has a cable seal in the cable end of the connector body which is identical to the cable seal in the seal well of the sealing grommet assembly.

5. A method of making a wiring harness comprising the steps of, providing a sealing grommet assembly which includes a support plate for attaching the sealing grommet assembly to a panel having a hole extending through the panel, and a seal well which includes a peripheral wall projecting from the support plate and a base ledge at the end of the peripheral wall spaced from the support plate, providing a first elastomeric cable seal which includes a plurality of apertures which extend through the elastomeric cable seal for slidably and sealingly engaging respective individual electrical conductors of the wiring harness, providing an electrical end connector which has a connector body having a cable end and a connector end, juxtaposing the sealing grommet assembly in an unattached relationship to the connector body so that the cable end of the connector body is adjacent and moveable with respect to the base ledge of the seal well of the sealing grommet assembly, and inserting the electrical conductors of the wiring harness through respective apertures of the first elastomeric cable seal after it is disposed in the seal well and thence into the connector body of the electrical end connector.

6. The method of making a wiring harness as defined in claim 5 wherein;

a second elastomeric cable seal having a plurality of apertures extending therethrough is disposed in the cable end of the connector body so that the electrical conductors, which are inserted into the connector body are inserted through the respective apertures of the second elastomeric cable seal.

7. The method of making a wiring harness as defined in claim 5 wherein the electrical conductors are inserted through the connector body of the electrical end connector and terminals are attached to the ends of the electrical conductors which have been inserted through the connector body.

8. The method of making a wiring harness as defined in claim 7 wherein a second elastomeric cable seal having a plurality of apertures extending therethrough is disposed in the cableend of the connector body so that the electrical conductors, which are inserted into the connector body are inserted through the respective apertures of the second elastomeric cable seal.

9. The method as defined in claim 8 wherein the first and second elastomeric cable seals are identical.

* * * * *